United States Patent [19]

Stanke

[11] 4,189,352

[45] Feb. 19, 1980

[54] COKE OVEN DOOR

[75] Inventor: Walter Stanke, Essen, Fed. Rep. of Germany

[73] Assignee: Krupp-Koppers, GmbH, Essen, Fed. Rep. of Germany

[21] Appl. No.: 849,329

[22] Filed: Nov. 7, 1977

Related U.S. Application Data

[63] Continuation of Ser. No. 706,532, Jul. 19, 1976, abandoned.

[30] Foreign Application Priority Data

Aug. 14, 1975 [DE] Fed. Rep. of Germany ..... 2536291

[51] Int. Cl.[2] ..... C10B 25/06; C10B 25/16

[52] U.S. Cl. ..... 202/248; 49/394; 49/480; 202/247

[58] Field of Search ..... 202/248, 269, 242, 247; 49/480, 485, 394, 501

[56] References Cited

U.S. PATENT DOCUMENTS

| | | | |
|---|---|---|---|
| 2,126,239 | 8/1938 | Beimann | 202/248 |
| 2,744,858 | 5/1956 | Homan | 202/248 |
| 2,867,012 | 1/1959 | Emley, Jr. | 49/480 |
| 2,965,550 | 12/1960 | McClure | 202/248 |
| 3,015,614 | 1/1962 | Bowman | 202/248 |
| 3,032,483 | 5/1962 | Van Ackeren et al. | 202/248 |
| 3,834,995 | 9/1974 | Van Ackeren | 202/248 |
| 3,974,038 | 8/1976 | Tucker | 202/248 |
| 3,977,125 | 8/1976 | Sudo | 49/480 |

FOREIGN PATENT DOCUMENTS

| | | | |
|---|---|---|---|
| 401698 | 2/1974 | U.S.S.R. | 202/248 |

*Primary Examiner*—Michael S. Marcus

*Attorney, Agent, or Firm*—Stanley J. Price, Jr.; John M. Adams

[57] ABSTRACT

A flexible seal member is secured to the periphery of the body of a coke oven door that is shaped to the contour of the receiving door jamb of the coke oven body. A seal edge of the seal member contacts the jamb in sealing relation. A plurality of spring pressing elements secured to the periphery of the door exert a constant sealing pressure on the seal member to maintain the seal member in sealing relation with the jamb. A plurality of stop mechanisms arranged on the periphery of the door maintain a preselected distance between the fastening point of the seal member to the door and the sealing surface of the jamb. A plurality of latching mechanisms positioned at selected regions on the door and secured to the coke oven body are operable to bend the door according to the contour of the jamb as the door experiences deformation during the coking operation. The bending of the door is also enhanced by reducing the moment of resistance of the door by providing longitudinal recesses therein. Thus, the seal member is maintained in sealing relation with the jamb as the door experiences deformation during the coking operation.

9 Claims, 4 Drawing Figures

COKE OVEN DOOR

CROSS REFERENCE TO RELATED APPLICATION

This application is a continuation of copending application Ser. No. 706,532 filed on July 19, 1976, entitled "Coke Oven Door," now abandoned.

BACKGROUND OF THE INVENTION

1. Field of the Invention

This invention relates to a seal member of a coke oven door for sealing the opening into the coke oven and more particuarly to a coke oven door seal member that is maintained in sealing engagement with the door jamb during the coking operation.

2. Description of the Prior Art

In a conventional coke oven battery the plurality of horizontal coking chambers or ovens have coke oven doors that seal the coke oven chamber open end portions. The coke oven doors provide a seal for the coke oven chambers during the coking operation so that the coal may be heated and coked under nonoxidative conditions. The coke oven doors are constructed so that the door is sealed when positioned in the coke oven door receiving frame or jamb. The coke oven doors are removed and the charge of coke is removed from the horizontal coking chambers by means of pusher machines.

It has been the customary practice to seal the coke oven doors with metal on metal seals in which the coacting sealing edges, such as angular membranes, Z-membranes, flat-iron member, wedge-shaped sealing edges and the like are provided. In addition a tarry material is deposited on the inner portion of the door and on the periphery of the sealing edge extending therearound during the coking operation. The tarry deposits evolved by the coal during the coking process also serve to seal the coke oven chamber by the formation of the deposits between the sealing surface of the jamb and the sealing surface of the member of the door. However, it is preferred that an effective seal be obtained by a combination of metalic sealing edges and elastic material (asbestos, plastic or the like), and to support the tarry deposits adjacent the edge by the plastic material.

During the coking operation the metal casting comprising the coke oven door body portion is subjected throughout its regions to differential heating and cooling over a wide range of temperatures resulting in deformation of the door body and the jamb. Therefore to compensate for the deformation and prevent leaks, pressing elements, such as pring-weighted pressing elements on the door and secured to the jamb, are utilized to exert pressure on the door to shape the door to the contour of the jamb. Shaping of the deformed door to the contour of the jamb for flat-iron members or wedge-shaped members is also accomplished by hammering and by adjustments to fastening elements that exert preselected forces on the flexible seal members.

Maintaining the seal between the coke oven door and the door jamb by hammering or adjusting the fastening elements on the door are not sufficient to compensate for the deformation experienced by relatively high coke oven doors. As a consequence of the differential heating to which the coke oven door is subjected during the coking operation, the door body changes shape or deforms within its elastic limits. For example, at the end of the coking period, the door is removed and the oven is freshly charged. During this period the coke oven door is subjected to a wide temperature differential. Over a rather long period of time, such extreme differential heating and cooling presents considerable problems in maintaining an effective seal around the coking chamber.

Conventional elastic door members that are adjustable on the door body and fitted by pressing elements tend to develop leaks after charging of the coal in the coking chamber. This condition is aggravated over long operating periods particularly when the deformations of the door and jamb are so extensive that a satisfactory adjustment of the flexible door seal members can no longer be maintained with conventional pressing elements designed to maintain the fitting line of the edge of the seal member on the jamb. The elastic or flexible region or working region of the sealing edge of the seal member is also subject to deformation or warpage particularly for an adjustable seal member and consequently expensive adjustments of the flexible member must be made in order to maintain the desired seal between the coke oven door and the coke oven chamber.

It is known to conform the body portion of the coke oven door to the contour of the jamb by the door machinery when the door is installed after charging or through pressing points located in the middle region of the door, such as by eccentric bolts. Eccentric bolts of this type are illustrated and described in German Pat. No. 1,214,646. The eccentric bolts are utilized as latching devices to secure the coke oven door to the coke oven frame. The latching takes place by lowering the door and the unlatching by lifting the door. The bolts serve to press the flexible seal member in contact with the sealing surface of the door jamb.

There is need to provide an effective seal between a coke oven door and a coke oven body portion that is easily and economically adjustable over the range of deformation of the door during the coking operation so that an effective seal is maintained for extended operating periods.

SUMMARY OF THE INVENTION

In accordance with the present invention there is provided a coke oven door that is secured to the jamb of the body portion of a coke oven and has an elongated body portion with a peripheral edge portion. A seal member is secured to and extends around the periphery of the door body portion. The seal member has a sealing edge portion that abuts the jamb to provide a seal between the door body portion and the jamb. Resilient devices secured to the door body portion maintain the seal edge portion in sealing relation with the jamb. Latching mechanisms supported by the door body portion connect the door body portion to the coke oven body. The latching mechanisms are positioned at selected regions on the door body portion. A plurality of stop mechanisms are positioned on the periphery of the door body portion adjacent the seal edge portion. The stop mechanisms engage the jamb and maintain the peripheral edge portion of the door body portion a preselected distance from the jamb to assure sealing contact of the seal edge portion therewith.

A plurality of longitudinal recesses are provided in the door body portion along the length thereof. The recesses serve to reduce the moment of resistance of the door body portion to effect bending thereof and provide uniform sealing engagment of the seal member seal edge portion with the jamb. The latching mechanisms also serve to effect bending of the door body portion and include spring latches and eccentric bolts that are positioned at the upper and lower regions of the door and at the middle region of the door respectively. The respective latching mechanisms are secured to the jamb on opposite sides of the door body portion. In particular, the eccentric bolts function to transfer the weight of the doors through the middle region thereof to the door. This permits adjustments in the shape of the door body portion to conform to the contour of the jamb and maintain an effective seal between the door body portion and the jamb.

The seal member includes a flexible seal portion that is secured to and extends around the periphery of the door body portion. The resilient devices for maintaining the seal edge in sealing engagement with the jamb include a pressing element that compresses a spring maintained in contact with a movable pin to urge the pin into contact with the sealing edge of the sealing member. With this arrangement, the sealing edge is maintained in contact with the sealing surface of the jamb. The latching mechanisms are also operable to maintain the distance between the fastening point of the sealing member on the periphery of the door to the surface of the jamb within the elastic limit of the seal member. Therefore, the resilient devices are capable of exerting a constant force on the sealing edge of the seal member to effect the desired seal around the periphery of the coke oven door regardless of the degree of the deformation in the door during the coking operation.

A plurality of stop mechanisms are positioned on the peripheral edge of the door body portion adjacent the seal member. The stop mechanisms adjust the distance between the fastening point of the seal member to the periphery of the door and the seal edge of the jamb. Thus, this distance is maintained within the elastic limit of the seal member so that the seal member may be maintained in contact with the jamb as the door portion experiences deformation due to the differential heating and cooling during the coking operation. The spring-weighted seal member is maintained in contact with the jamb as regions of the coke oven door body portion are subjected to differential heating and cooling. With this arrangement the seal member is self-adjusting to maintain a constant sealing force on the surface of the jamb.

Accordingly, the principal object of the present invention is to provide a coke oven door for closing the coking chamber of a coke oven in which a seal is effected between the periphery of the coke oven door and the frame or jamb on the coke oven body portion as the coke oven door deforms upon heating and cooling during the coking process.

Another object of the present invention is to provide an effective seal between a coke oven door and the jamb of the coke oven by a flexible seal member that is maintained in sealing relation with the jamb for all degrees of deformation of the coke oven door body portion. An additional object of the present invention is to provide a flexible seal member for a coke oven door on a coke oven in which the seal member is adjustable within its elastic limit to maintain a constant sealing pressure on the jamb for varying operating conditions of the coke oven that contribute to differential deformation of the coke oven throughout the regions of the door.

A further object of the present invention is to provide a seal for a coke oven door that includes a plurality of latching mechanisms that maintain the door in a preselected position on the coke oven so that a flexible seal member is maintained within its elastic limit to effectively engage in sealing relation the jamb of the door regardless of the degree of deformation experienced by the door during the coking operation.

These and other objects of the present invention will be more completely disclosed and described in the following specification, the accompanying drawings and the appended claims.

DESCRIPTION OF THE PREFERRED EMBODIMENT

Figure 1:
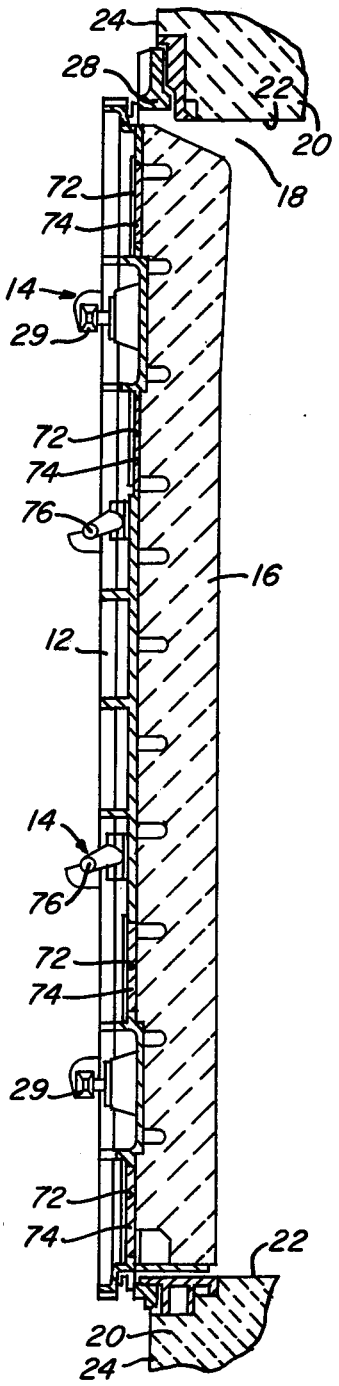
FIG. 1 is a view in side elevation and partially in section of a coke oven door, illustrating the sealing engagement of the seal member on the periphery of the coke oven door with the jamb of the coke oven body.
Figure 2:
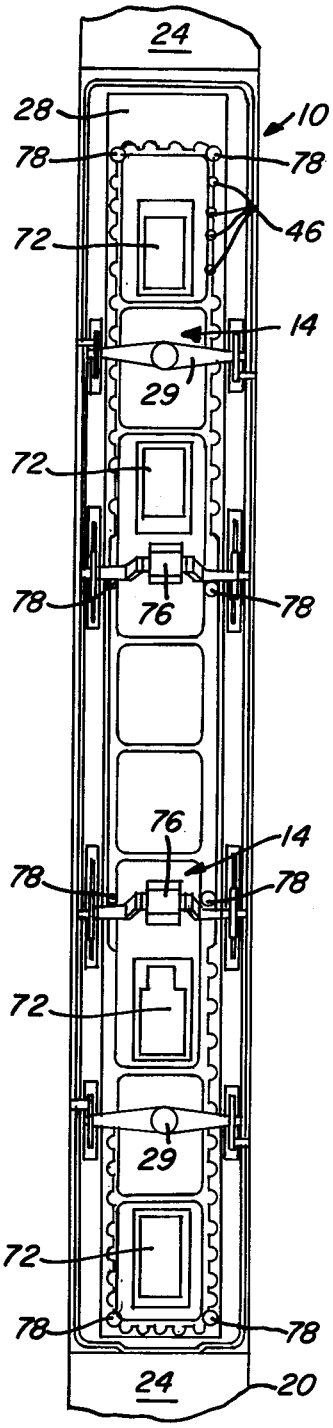
FIG. 2 is a view in front elevation of the coke oven door secured to the coke oven body illustrated in FIG. 1.
Figure 3:
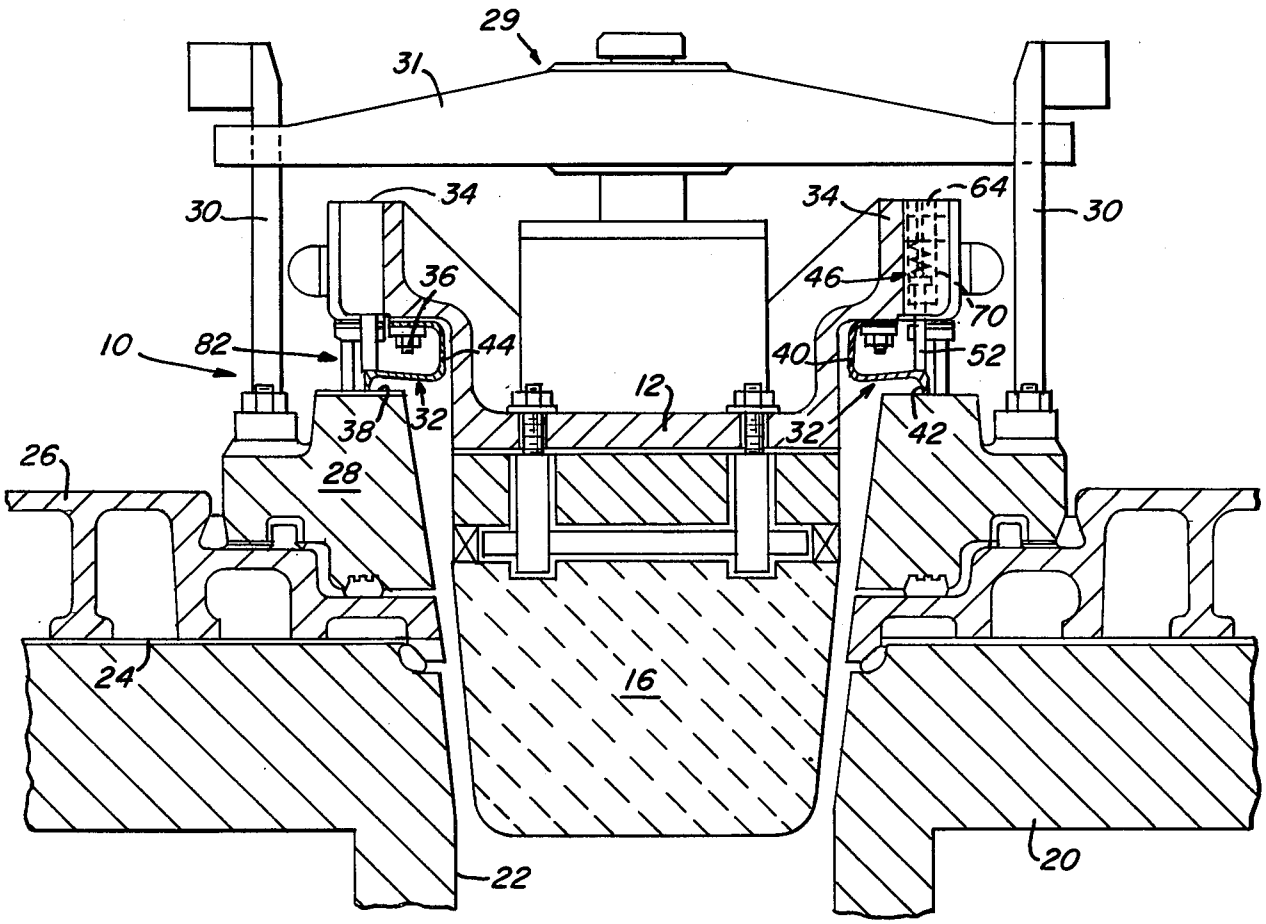
FIG. 3 is a sectional top plan view of a coke oven door, illustrating the seal member maintained in sealing relation with the jamb of the coke oven body portion.

Referring to the drawings and particularly to FIGS. 1, 2 and 3, there is illustrated a coke oven door generally designated by the numeral 10 that has an elongated body portion 12 with rearwardly extending door latching mechanisms generally designated by the numeral 14 located adjacent the upper and lower and middle regions of the door body portion 12. The body portion 12 is conventionally formed as a metal casting and has suitable bolt receiving bores formed therein. Secured to the front face of the body portion 12 is a refractory lining 16. The refractory lining 16 extends into a coking chamber 18 formed by the coke oven body portion 20. The coke oven body portion has parallel heating walls 22 forming the coking chamber 18 and vertical external walls 24 for supporting a sectional coke oven door receiving frame 26. A vertical jamb 28 is secured to the door frame 26 adjacent to the opening into the coking chamber 18 on opposite sides of the coke oven door refractory lining 16. The door latching mechanisms 14 include spring latches 29 at the upper and lower regions of the door. Brace members 30 of the latches 29 are rigidly secured to the jamb 28 by an adjustable spring biased latch bar 31. With this arrangement coke oven door 10 is secured to the coke oven door frame 26 so that the refractory lining 16 projects into the coking chamber 18 to close the opening therein.

Figure 4:
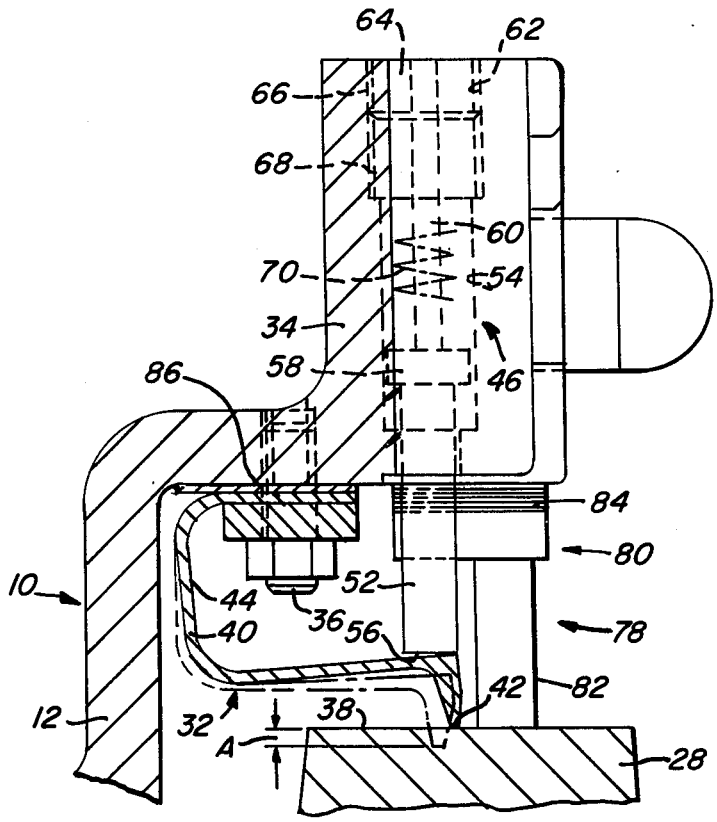
FIG. 4 is an enlarged sectional view of the seal member maintained in sealing relation with the surface of the jamb of the coke oven body, illustrating a spring pressing element and a stop mechanism for effecting a seal between the coke oven door and the jamb.

A generally U-shaped flexible resilient metal seal member generally designated by the numeral 32 is secured to the peripheral edge 34 of coke oven door 10 by means of bolts 36 as illustrated in FIG. 3 and 4. The seal member 32 extends around the periphery 34 of the coke oven door 10 adjacent to a planar sealing surface 38 of the jamb 28 of the sides of the coke oven door. The seal member 32 has a laterally extending body portion 40 with a pair of spaced leg portions, one of the leg portions secured to the coke oven door by bolts 36 and the other leg portion having an inturned sealing edge portion 42. The seal member 32 has an inner surface 44 that is substantially parallel to the coke oven door body portion 12. With this arrangement the coke oven door 10 is arranged to be positioned on the coke oven door frame 26 with the refractory lining 16 extending into the coking chamber 18. The sealing edge portion 42 of the seal member 32 engages in sealing relation the sealing surface 38 of jamb 28 to provide a seal between the coke oven door 10 and the door frame 26.

The sealing relation between the sealing edge portion 42 of the seal member 32 with the sealing surface 38 of the jamb 28 is developed by a plurality of resilient devices generally designated by the numeral 46 and illustrated in detail in FIGS. 3 and 4. The resilient devices 46 are retained on the door edge 34 around the periphery of the body portion 12 as illustrated in FIG. 2. The resilient devices 46 maintain sealing engagement of the sealing membrane 32 with the jamb 28. The seal member 32 is flexible and is operable to maintain contact with the coke oven door frame as the coke oven door experiences deformation under the influence of differential heating and cooling during the coking process.

As illustrated in FIG. 4, the seal member 32 is flexible within the limits of deformation of the coke oven door body portion 12. In the relaxed or non-deflected position of the member 32, as indicated by the dotted lines, the sealing edge portion 42 extends beyond the sealing surface 38 of the jamb 28 by a distance "A." This assures that the sealing edge portion 42 remains in sealing engagement with the surface 38 by operation of the resilient devices 46. The resilient devices 46 each include a movable pin 52 retained within a bore 54 on the peripheral edge 34 of the door. End portion 56 of pin 52 remains in pressing engagement with the exterior surface of the seal member 32. The opposite end of pin 52 includes a plunger 58 having a rod member 60. The outer end portion of the bore 54 includes a threaded portion 62 arranged to receive a spring pressing element 64 having a threaded portion 66 secured within the threaded portion 62 and a cylindrical portion 68. The rod member 60 extends through a bore in the pressing element 64 and is movable therein.

A resilient member, such as a spring 70, is retained in a compressed state within the bore 54 between the plunger 58 and the pressing element cylindrical portion 68. Thus, by advancing the pressing element 64 a preselected distance into the threaded bore 62, the spring 70 is compressed to apply through the pin 52 a preselected pressure on the seal member 32. In this manner the necessary pressing force is achieved by the seal member edge 42 on the jamb sealing surface 38 to complete the seal around the coke oven door 10.

As discussed hereinabove the door spring latches 29 connect the door body portion 12 to the jamb 28. The spring latches 29 exert a preselected force on the upper and lower regions of the door body portion 12 to bend or shape the door to the contour of the jamb. In this manner compensation is made for deformation or warpage of the door during the coking operation. The door body portion is constantly subjected to a wide temperature differential and the regions of the door experience varying degrees of deformation which tend to break the seal between the door 10 and the coke oven body 20. Therefore, it is the function of the spring latches 29 to compensate for the deformation of the door and maintain the requisite pressing forces on the flexible seal member 32 to effect the constant engagement of the seal member edge 42 with the jamb sealing surface 38.

A longitudinal recess 72 is provided in the coke oven door body portion 12 above and below each spring latch 29, as illustrated in FIGS. 1 and 2. The recesses 72 serve to reduce the movement of resistance of the metal door body portion 12 and may be filled or covered with an asbestos sheet 74 or the like. The door latching mechanism 14 also includes a pair of eccentric bolts 76 that are positioned in the middle region of the door body portion 12 at a preselected location of the jamb 28 and position the door at the proper height on the coke oven door frame 26. The end portions of the eccentric bolts 76 are secured to the door frame 26. With this arrangement the bolts 76 transfer the weight of the door through the middle region of the door body portion to the jamb 28 on the door frame 26. The shape of the door body portion 12 is thus adjusted to the contour of the jamb to maintain the seal between the door body portion 12 and the jamb 28 and accommodate deformations of the door body portion 12.

The reduction in the mass of the door body portion 12 achieved by the longitudinal recesses 72 facilitates bending of the door body portion at the middle regions thereof in conformity with the contour of the encountered jamb. Thus, the seal member 32 may be maintained in sealing relation with the jamb 28 throughout the range of deformation of the door during the coking process. A uniform fit of the member sealing edge 42 is provided on all sides of the sealing surface 38 of the jamb 28. The operation of the latching mechanism 14, i.e., the eccentric bolts 76 and the spring latches 29, is not required to maintain seal member engagement of the sealing membrane 32 with the door jamb 28 at the middle regions of the door. This is accomplished by the weight of the door body portion 12 being applied to the jamb 28. Thus, the spring latching mechanisms 14 are confined to sealing and shaping the upper and lower and middle regions of the door body portion 12. As stated, the door latching mechanisms 14 are operable to compensate for the deformation of the door body portion that takes place during the coking operation to maintain the desired seal between the door and the door frame to prevent leakage from the coking chamber 18.

The seal membrane 32 is elastic or flexible to compensate for warpage of the door body. To assure that the peripheral edge 34 of coke oven door 10 is maintained a preselected distance from the jamb 28 which is in the range of elasticity or flexibility of the member 32, a plurality of stop mechanisms 78 are positioned on the periphery 34 of the door adjacent the sealing edge portion 42. Preferably stop mechanisms are located at each corner, and a pair are arranged on each side in the middle region of the door body portion, as illustrated in FIG. 2.

Each stop mechanism, as illustrated in FIG. 4, includes an adjusting device 80 for controlling the length of the stop to position the peripheral edge 34 of the body portion 12 a preselected distance from the jamb sealing surface 38. The adjusting device 80 includes an elongated stop member 82 positioned between the door peripheral edge 34 and the jamb surface 38. One end portion of the stop member 82 contacts the sealing surface 38. A plurality of supporting disks generally designated by the numeral 84 are positioned between the door peripheral edge 34 and the opposite end of the stop member 82. The supporting disks 84 are arranged in overlying relation between the door peripheral edge 34 and the end of stop member 82 to control the distance between the door edge 34 and the jamb 28. In this manner bending or deformation of the door body portion 12 on the jamb 28 by the spring latches 29 and the eccentric bolts 76 is maintained within the elastic limit of the member 32 so that the member 32 contacts the jamb sealing surface 38.

The distance between the seal member fastening point 86 and the sealing edge 38 is adjusted by the stop members 82 through the supporting disks 84. As indicated in FIG. 4, in a relaxed or non-deflected position relative to the surface 38, the edge 42 of member 32 extends beyond the end of stop member 82. Thus, the stop members 82 assure that the edge 42 contacts the jamb surface 38 and is maintained thereon by the force applied by the pressing elements 64. Accordingly, by changing the length of the stop member 82 through the disks 84, the limits of elasticity of the seal member 32 are controlled to apply an increased or decreased pressure on the sealing surface 38 as determined by the degree of deformation of the door body portion 12. Thus, the optimum flexible region of the sealing membrane 32 is determined by the distance the stop mechanisms 78 maintain the fastening point 86 from the sealing surface 38. The preselected distance is maintained uniformly around the periphery of the coke oven door 10.

The latching mechanism 14 in combination with the stop mechanisms 78 serve to maintain distortion of the door body portion 12 within the range of the elastic limit of the seal member 32. An effective seal is provided by this arrangement primarily because the deformation stresses of the door are absorbed by the mass of the door body portion. In addition, the spring-urged flexible member 32 is operable to respond to deformations of the door at the various regions thereof by yielding within its elastic limit. This assures that sealing edge 42 remains in contact with the sealing surface 38.

Regardless of the degree of deformation of the coke oven door body portion 12 a uniform distance is maintained between the fastening point 86 on the door peripheral edge 34 and the sealing surface 38 of the jamb 28. This feature is accomplished by the reduction in the mass of the body portion 12 achieved through the longitudinal recesses 72. The reduction of the door body and reduced moment of resistance thereof allows the door to be bent in accordance with the contour of the jamb. Bending the door body portion 12 occurs when the door is replaced on the door frame 26 after the charging operation by the door machinery. The door machine grasps the door 10 at the middle region and applies pressure to the door as it is positioned on the frame 26 thereby adapting the door body portion to the contour of the frame. Pressure, of course, is also applied to the middle region of the door by the eccentric bolts 76, and pressure is applied to the upper and lower regions of the door by the spring latches 29.

Adapting the door to the contour of the jamb and securing it to the door frame maintains an effective seal around the door because the seal member 32 is maintained within its elastic limit to constantly maintain the requisite seal on the sealing surface 38 of the jamb 28. With the fastening point 86 maintained a distance from the sealing surface 38 which is within the elastic limit of the sealing membrane 32, the resilient devices 46 maintain a constant sealing pressure on the membrane 32 regardless of the degree of deformation of the coke oven door 12. Thus, an effective seal is maintained between the coke oven door and the jamb without adjustment during the coking operation and the regions of the door are subjected to differential heating and cooling.

According to the provisions of the patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A coke oven door assembly for a coke oven comprising, an elongated door body portion having a peripheral edge portion, a resilient generally U-shaped seal member having a body portion and a pair of spaced leg portions, one of said leg portions secured to said door body portion, said resilient seal member secured to and extending around the periphery of said door body portion, a coke oven door jamb having a peripheral sealing surface, said resilient generally U-shaped seal member having a sealing edge extending from said other leg portion, said sealing edge arranged to abut said coke oven door jamb peripheral sealing surface to provide a seal between said door body portion and said coke oven door jamb peripheral sealing surface, said resilient seal member leg portions spaced from each other a preselected distance in a relaxed position, said resilient seal member other leg portion being arranged to be deflected so that said leg portions are spaced at a distance less than said preselected distance, resilient abutment means secured to said door body portion adjacent said peripheral edge portion of said door body portion, said resilient abutment means having an end portion arranged to be positioned in abutting relation with said resilient seal member other leg portion adjacent said resilient seal member sealing edge so that said resilient abutment means end portion urges said resilient seal member sealing edge into sealing relation with said sealing surface of said door jamb, adjustable latching means mounted on said door body portion adjacent the upper and lower portions of said door body portion for urging said door upper and lower portions toward said coke oven door jamb, a plurality of stop mechanisms positioned on the periphery of said door body portion adjacent said resilient seal member seal edge portion, said stop mechanism arranged to abut said door jamb peripheral sealing surface, said stop mechanisms having a length which is less than said preselected distance between the spaced leg portions of said resilient seal member in a relaxed position so tht said resilient seal member is deflected and maintained in a compressed state and said resilient seal member sealing edge is urged into sealing relation with said door jamb peripheral sealing surface, said stop mechanisms each including a stop member positioned between said coke oven door peripheral edge portion and the peripheral sealing surface of said door jamb with one end portion of said stop member contacting said peripheral sealing surface of said door jamb, a plurality of supporting disks positioned between said peripheral edge and the opposite end portion of said stop member, and said supporting disks arranged to maintain a preselected distance between said coke oven door peripheral edge portion and said door jamb peripheral sealing surface to limit bending of said door body portion and the jamb and maintain said seal member in a compressed state and said seal member sealing edge portion in a sealing relation with said door jamb peripheral sealing surface.

2. A coke oven door assembly as set forth in claim 1 in which, said stop mechanisms include means for adjusting the effective length thereof to maintain said coke oven door peripheral edge portion a preselected distance from said door jamb peripheral edge portion to limit further bending of said door body portion by said adjustable latch means and maintain said seal member sealing edge portion in sealing relation with said door jamb peripheral sealing surface.

3. A coke oven door assembly as set forth in claim 1 in which, said stop member and supporting disks are arranged to be positioned at each corner of said door body portion and on each side thereof at the middle region of said door body portion.

4. A coke oven door assembly as set forth in claim 1 in which said resilient abutment means includes, a plurality of spring assemblies positioned on the periphery of said door body portion adjacent said seal member, said spring assemblies each including a pin member movably retained on the periphery of said door body portion with one end portion contacting said resilient seal member other leg portion, a pressing element threadedly secured to said door body portion and spaced from said pin member, a spring retained in a compressed state between said pressing element and said movable pin member, and said pressing element being adjustable on said door body portion to compress said spring and apply through said pin member a preselected pressure on said seal member to maintain said seal member seal edge in sealing engagement with the coke oven peripheral sealing surface jamb.

5. A coke oven door assembly as set forth in claim 4 which includes, a plurality of recesses provided in said door body portion at selected regions thereof along the length of said door body portion, said recesses arranged to reduce the amount of resistance of said door body portion to effect bending thereof by said adjustable ltch means and provide substantially uniform space between said coke oven door peripheral edge portion and said door jamb peripheral sealing surface to thereby maintain sealing engagement of said seal member seal edge portion with said door jamb peripheral sealing surface.

6. A coke oven door assembly as set forth in claim 5 in which, said recesses extending longitudinally on said door body portion, said recesses being positioned on said door body portion adjacent said latching means at the upper and lower regions of said door body portion.

7. A coke oven door assembly as set forth in claim 1 in which said adjustable latching means includes, a plurality of spring actuated latches secured to the upper and lower regions of said door body portion, and said spring actuated latches each having a bar member connected to the jamb so that said coke oven door upper and lower portions are urged toward said door jamb peripheral sealing surface.

8. A coke oven door assembly as set forth in claim 7 in which, said spring actuated latches are secured to said coke oven door jamb and position said coke oven door body portion at a preselected distance from said door jamb peripheral sealing surface at the upper and lowr regions thereof and thereby shape the upper and lower door regions to the contour of the jamb.

9. A coke oven door assembly for a coke oven comprising, an elongated door body portion having a peripheral edge portion, a resilient generally U-shaped seal member having a body portion and a pair of spaced leg portions, one of said leg portions secured to said door body portion, said resilient seal member secured to and extending around the periphery of said door body portion, a coke oven door jamb having a peripheral sealing surface, said resilient generally U-shaped seal member having a sealing edge extending from said other leg portion, said sealing edge arranged to abut said coke oven door jamb peripheral sealingsurface to provide a seal between said door body portion and said coke oven door jamb peripheral sealing surface, said resilient seal member leg portions spaced from each other a preselected distance in a relaxed position, said resilientseal member other leg portion being arranged to be deflected so tht said leg portions are spaced at a distance less than said preselected distance, resilient abutment means secured to said door body portion adjacent said peripheral edge portion of said door body portion, said resilient abutment means having an end portion arranged to be positioned in abutting relation with said resilient seal member other leg portion adjacent said resilient seal member sealing edge so that said resilient abutment means end portion urges said resilient seal member sealing edge into sealing relation with said sealing surface of said door jamb, adjustable latching means mounted on said door body portion adjacent the upper and lowr portions of said door body portion for urging said door upper and lower portions toward said coke oven door jamb, a plurality of stop mechanisms positioned on the periphery of said door body portion adjacent said resilient seal member seal edge portion, said stop mechanism arranged to abut said door jamb peripheral sealing surface, aid stop mechanisms having a length which is less than said preselected distance between the spaced leg portions of said resilient seal member in a relaxed position so that said resilient member is deflected and maintained in a compressed state and said resilient seal member sealing edge is urged into sealing relation with said door jamb peripheral sealing surface, other latching means having a plurality of eccentric bolts positioned at the middle region of said coke oven door body portion and secured to said coke oven door jamb on opposite sides of said doorportion to rigidly position said door body portion at a preselected location on said coke oven door jamb peripheral sealing surface, and said eccentric bolts being secured to said door body portion and the jamb such that the weight of said door vody portion is transferred through the middle region thereof to the jamb.

* * * * *